US010938087B2

(12) United States Patent
Qing et al.

(10) Patent No.: US 10,938,087 B2
(45) Date of Patent: Mar. 2, 2021

(54) ANTENNA STRUCTURE FOR A RADIO FREQUENCY IDENTIFICATION (RFID) READER, METHOD OF MANUFACTURING THEREOF, RFID READER AND RFID SYSTEM

(71) Applicant: AGENCY FOR SCIENCE, TECHNOLOGY AND RESEARCH, Singapore (SG)

(72) Inventors: Xianming Qing, Singapore (SG); Zhining Chen, Singapore (SG); Chean Khan Goh, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 196 days.

(21) Appl. No.: 15/547,477

(22) PCT Filed: Feb. 1, 2016

(86) PCT No.: PCT/SG2016/050049
§ 371 (c)(1),
(2) Date: Jul. 28, 2017

(87) PCT Pub. No.: WO2016/122415
PCT Pub. Date: Aug. 4, 2016

(65) Prior Publication Data

US 2018/0006355 A1 Jan. 4, 2018

(30) Foreign Application Priority Data

Jan. 30, 2015 (SG) ..... 10201500771X

(51) Int. Cl.
*H01Q 1/36* (2006.01)
*H01Q 1/22* (2006.01)
(Continued)

(52) U.S. Cl.
CPC ..... *H01Q 1/2216* (2013.01); *H01Q 1/36* (2013.01); *H01Q 1/38* (2013.01); *H01Q 7/00* (2013.01); *H01Q 21/0087* (2013.01)

(58) Field of Classification Search
CPC ..... H01Q 1/2216; H01Q 1/36; H01Q 1/38; H01Q 7/00; H01Q 21/0087
See application file for complete search history.

(56) References Cited

U.S. PATENT DOCUMENTS 2,797,393 A * 6/1957 Clogston ..... B01J 39/02 333/239
5,777,581 A 7/1998 Lilly et al.
(Continued)

FOREIGN PATENT DOCUMENTS

WO WO1988002189 * 3/1988 ..... H01Q 9/44
WO WO 2009/141653 A1 11/2009

OTHER PUBLICATIONS

PCT International Search Report for PCT Counterpart Application No. PCT/SG2016/050049, 3 pgs, dated Mar. 16, 2016.
(Continued)

*Primary Examiner* — Dimary S Lopez Cruz
*Assistant Examiner* — Bamidele A Jegede
(74) *Attorney, Agent, or Firm* — Womble Bond Dickinson (US) LLP

(57) ABSTRACT

There is provided an antenna structure for a radio frequency identification (RFID) reader. The antenna structure includes a substrate, and an antenna structure disposed on the substrate. The antenna includes a peripheral frame portion, a first strip section disposed at a first side of the peripheral frame portion, and a second strip section disposed at a second side of the peripheral frame portion. In particular, the first strip section and the second strip section each includes multiple spaced-apart strip portions extending from a first part of the peripheral frame portion to a second part of the
(Continued)

peripheral frame portion. There is also provided a method of manufacturing the antenna structure, an RFID reader system including the antenna structure, and an RFID system including the RFID reader system and an RFID tag.

18 Claims, 13 Drawing Sheets

(51) Int. Cl.
*H01Q 7/00* (2006.01)
*H01Q 1/38* (2006.01)
*H01Q 21/00* (2006.01)

(56) References Cited

U.S. PATENT DOCUMENTS 6,326,920 B1* 12/2001 Barnett ..... H01Q 1/246 343/700 MS
2003/0034917 A1* 2/2003 Nishizawa ..... H01Q 1/38 343/700 MS
2004/0227664 A1* 11/2004 Noujeim ..... H01Q 1/38 343/700 MS
2006/0214867 A1* 9/2006 Chen ..... H01Q 9/285 343/795
2007/0171071 A1* 7/2007 Chiu ..... H01Q 1/2208 340/572.7
2008/0068177 A1* 3/2008 Copeland ..... G06K 19/0726 340/572.7
2008/0088460 A1* 4/2008 Copeland ..... H01Q 1/2216 340/572.7
2008/0094282 A1* 4/2008 Qin ..... H01Q 9/42 343/700 MS
2008/0303734 A1* 12/2008 Teshirogi ..... H01Q 13/26 343/785
2009/0002130 A1* 1/2009 Kato ..... G06K 19/07749 340/10.1
2009/0189729 A1* 7/2009 Kubo ..... G06K 19/07749 336/221
2010/0309088 A1* 12/2010 Hyvonen ..... H01Q 7/00 343/867
2011/0114735 A1* 5/2011 Ziai ..... G06K 19/07786 235/492
2011/0128125 A1* 6/2011 Kai ..... H01Q 11/18 340/10.1
2011/0169770 A1 7/2011 Mishina et al.
2013/0320098 A1* 12/2013 Mukai ..... H01Q 9/16 235/492
2014/0091149 A1* 4/2014 Finn ..... G06K 19/07794 235/492
2014/0320367 A1* 10/2014 Alkhateeb ..... H01Q 1/3291 343/804
2015/0207205 A1* 7/2015 Kato ..... H01Q 7/06 343/702
2015/0303573 A1* 10/2015 Tomonari ..... H01Q 7/06 343/788
2015/0318609 A1* 11/2015 Tomonari ..... H01Q 1/243 343/788

OTHER PUBLICATIONS

PCT Written Opinion, for PCT Counterpart Application No. PCT/SG2016/050049, 3 pgs, dated Mar. 16, 2016.

* cited by examiner

ANTENNA STRUCTURE FOR A RADIO FREQUENCY IDENTIFICATION (RFID) READER, METHOD OF MANUFACTURING THEREOF, RFID READER AND RFID SYSTEM

CROSS-REFERENCE TO RELATED APPLICATIONS

This patent application is a U.S. National Phase Application under 35 U.S.C. § 371 of International Application No. PCT/SG2016/050049, filed on 1 Feb. 2016, entitled ANTENNA STRUCTURE FOR A RADIO FREQUENCY IDENTIFICATION (RFID) READER, METHOD OF MANUFACTURING THEREOF, RFID READER AND RFID SYSTEM, which claims the benefit of priority of Singapore Patent Application No. 10201500771X, filed on 30 Jan. 2015, the content of which was incorporated by reference in its entirety for all purposes.

TECHNICAL FIELD

The present invention generally relates to an antenna structure for a radio frequency identification (RFID) reader, a method of manufacturing thereof, an RFID reader system comprising the antenna structure and an RFID system comprising the RFID reader system and an RFID tag.

BACKGROUND

Radio frequency identification (RFID) is a technology capable of being utilized to wirelessly identify and/or track articles/objects in, for example, warehouses, supply chains, control systems, and automation processes. Employing semiconductor-based wireless technology, the RFID reader of an RFID system transmits a modulated radio frequency (RF) signal to the RFID tag comprising an antenna and an integrated circuit chip. The chip may receive power from the antenna and responds by varying its input impedance, thus modulating the backscattered signal. Therefore, RFID systems may be applied to, for example, simultaneously read/write multiple tags and activate remote sensing devices based on their unique identifications (IDs) conveniently and selectively.

For a high frequency (HF) RFID system, the RFID reader antenna and tags can couple each other either magnetically (inductively) or electrically (capacitively). Inductively coupling RFID systems are preferred in most applications since the majority of reactive energy is stored in the magnetic field. These systems are only affected by objects with high magnetic permeability, and therefore they are able to operate in close proximity to metals and liquids. In contrast, capacitive coupling RFID systems are hardly used in practical applications because the energy stored in the electric field is severely affected by objects with high dielectric permittivity.

Antenna is one of the key components for RFID system. The detection/identification accuracy is directly dependent on the antenna's performance. In addition, optimized low-cost antenna design will benefit the system with better detection accuracy, reduced antenna fabrication cost, simple system configuration, and implementation cost reduction. For a HF RFID system, it would be beneficial to improve the magnetic field generated by the reader antenna in order to enlarge the interrogation zone of the reader antenna so as to increase its reading distance and detection accuracy. As a result, for example, a desired magnetic field intensity/distribution in specific zone for various applications may then be achieved.

Although the magnetic field generated by the RFID reader antenna may be improved by simple approaches such as changing the overall size/dimension of the reader antenna and/or increasing the transmitting power, however, simply adopting such approaches without any improvement in the reader antenna's design may be undesirable in various circumstances. For example, the transmitting power cannot simply be increased to increase the reading distance as the maximum radiated power of an RFID reader for various applications may be regulated, thus rendering such an approach impractical. On the other hand, simply changing the overall size of the reader antenna may not be a practical approach in various circumstances where design restrictions impose a limit on the overall size of the reader antenna to maintain a specific interrogation zone for efficient RFID tag detection.

A need therefore exists to provide an antenna structure for an RFID reader with improved antenna design/configuration that results in better performance in magnetic field (or electromagnetic field) generation, such as an increase in the strength of the magnetic field. It is against this background that the present invention has been developed.

SUMMARY

According to a first aspect of the present invention, there is provided an antenna structure for a radio frequency identification (RFID) reader, the antenna structure comprising:

a substrate; and an antenna disposed on the substrate, the antenna comprising:

a peripheral frame portion;

a first strip section disposed at a first side of the peripheral frame portion; and a second strip section disposed at a second side of the peripheral frame portion, wherein the first strip section and the second strip section each comprises a plurality of spaced-apart strip portions extending from a first part of the peripheral frame portion to a second part of the peripheral frame portion.

In various embodiments, the first part is a lower part of the peripheral frame portion and the second part is an upper part of the peripheral frame portion.

In various embodiments, the first side is opposite to the second side, and the first strip section disposed at the first side and the second strip section disposed at the second side define an opening therebetween in the antenna.

In various embodiments, the spaced-apart strip portions in the first strip section and/or the second strip section are substantially parallel to each other.

In various embodiments, the first strip section and the second strip section are substantially symmetrical with respect to a central axis of the antenna passing through the first and second parts of the peripheral frame portion.

In various embodiments, the first strip section and the second strip section are asymmetrical with respect to a central axis of the antenna passing through the first and second parts of the peripheral frame portion.

In various embodiments, each adjacent pair of the spaced-apart strip portions in the first strip section is spaced apart by a first distance and each adjacent pair of the spaced-apart strip portions in the second strip section is spaced apart by a second distance, and wherein the first distance and the second distance are substantially the same.

In various embodiments, each adjacent pair of the spaced-apart strip portions in the first strip section is spaced apart by a first distance and each adjacent pair of the spaced-apart strip portions in the second strip section is spaced apart by a second distance, and wherein the first distance and the second distance are different.

In various embodiments, at least one of the adjacent pairs of the spaced-apart strip portions in the first strip section is spaced apart by a distance which is different to that of another adjacent pair of the space-apart strip portions in the first strip section, and/or at least one of the adjacent pairs of the spaced-apart strip portions in the second strip section is spaced apart by a distance which is different to that of another adjacent pair of the space-apart strip portions in the second strip section.

In various embodiments, widths of the spaced-apart strip portions in the first strip section and/or widths of the spaced-apart strip portions in the second strip section are substantially the same.

In various embodiments, at least one of the spaced-apart strip portion in the first strip section has a width which is different to a width of another spaced-apart strip portion in the first strip section, and/or at least one of the spaced-apart strip portion in the second strip section has a width which is different to a width of another spaced-apart strip portion in the second strip section.

In various embodiments, the peripheral frame portion forms a closed shape.

In various embodiments, the peripheral frame portion forms a shape selected from the group consisting of circle, oval, and polygon.

In various embodiments, the peripheral frame portion and the plurality of spaced-apart strip portions in the first strip section and the second strip section are made of conductive metallic strips and/or conductive wires.

In various embodiments, the antenna structure further comprises another antenna disposed on the substrate, said antenna and said another antenna being disposed on opposite sides of the substrate, said another antenna comprising:

a peripheral frame portion;

a first strip section disposed at a first side of the peripheral frame portion; and a second strip section disposed at a second side of the peripheral frame portion, wherein the first strip section and the second strip section each comprises a plurality of spaced-apart strip portions extending from a first part of the peripheral frame portion to a second part of the peripheral frame portion, wherein said antenna and said another antenna are electrically coupled to each other.

According to a second aspect of the present invention, there is provided a method of manufacturing an antenna structure for a radio frequency identification (RFID) reader, the method comprising:

providing a substrate;

forming an antenna on the substrate, the antenna comprising:

a peripheral frame portion;

a first strip section disposed at a first side of the peripheral frame portion; and a second strip section disposed at a second side of the peripheral frame portion, wherein the first strip section and the second strip section each comprises a plurality of spaced-apart strip portions extending from a first part of the peripheral frame portion to a second part of the peripheral frame portion.

In various embodiments, the peripheral frame portion and the plurality of spaced-apart strip portions in the first strip section and the second strip section are made of conductive metallic strips and/or conductive wires.

According to a third aspect of the present invention, there is provided a radio frequency identification (RFID) reader system, comprising an antenna structure as described herein configured to communicate with an RFID tag through an inductive coupling.

In various embodiments, the RFID reader system further comprising:

an RFID reader comprising a radio frequency source for generating a radio frequency signal, wherein the radio frequency signal is coupled to the antenna structure, and the antenna structure is configured to generate a magnetic field based on the radio frequency signal for communicating with the RFID tag, and an impedance matching circuit coupled to the antenna structure for enhancing impedance matching between the antenna structure and the RFID reader.

According to a third aspect of the present invention, there is provided a radio frequency identification (RFID) system comprising:

an RFID reader system as described herein, and an RFID tag having stored therein information associated with an article, wherein the RFID reader system is configured to communicate with the RFID tag through an inductive coupling to obtain the information associated with the article.

BRIEF DESCRIPTION OF THE DRAWINGS

Embodiments of the present invention will be better understood and readily apparent to one of ordinary skill in the art from the following written description, by way of example only, and in conjunction with the drawings, in which.

DETAILED DESCRIPTION

Embodiments of the present invention provide an antenna structure for a radio frequency identification (RFID) reader (or RFID reader system). An RFID reader system may comprise an RFID reader comprising a radio frequency (RF) source (or RF transceiver) for generating an RF signal, and an antenna structure connected/coupled to the RFID reader for generating a magnetic field (or electromagnetic field) based on the RF signal for communication with one or more RFID tags. Therefore, a key factor in determining the RFID reader's reading distance and detection accuracy is the strength of the magnetic field generated by the antenna structure.

As discussed in the background of the present specification, it would be beneficial to improve the magnetic field generated by the reader antenna in order to enlarge the interrogation zone of the reader antenna so as to increase its reading distance and detection accuracy. As a result, for example, a desired magnetic field intensity/distribution in specific zone for various applications may then be achieved. As also discussed in the background, although the magnetic field generated by the reader antenna may be improved by simple approaches such as changing the overall size/dimension of the reader antenna and/or increasing the transmitting power, however, simply adopting such approaches without any improvement in the reader antenna's design may be undesirable in various circumstances. Therefore, embodiments of the present invention seeks to provide an antenna structure for an RFID reader with improved antenna design/configuration that results in better performance in magnetic field (or electromagnetic field) generation.

Figure 1:
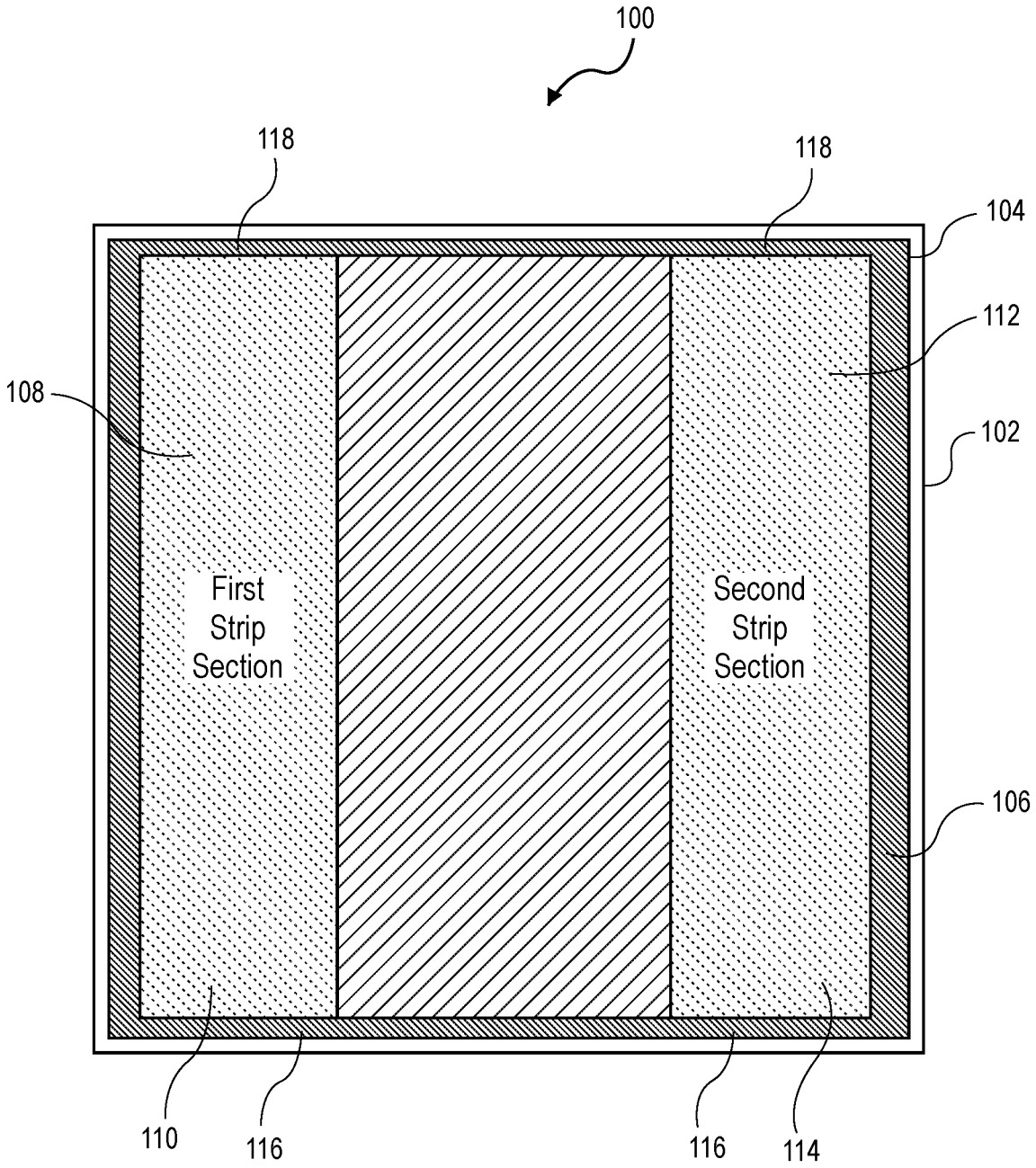
FIG. 1 depicts a schematic drawing of an antenna structure for a radio frequency identification (RFID) reader according to various embodiments of the present invention.

FIG. 1 depicts a schematic drawing of an antenna structure 100 for a radio frequency identification (RFID) reader according to various embodiments of the present invention. The antenna structure 100 comprises a substrate 102, and an antenna 104 disposed on the substrate 102. The antenna 104 comprises a peripheral frame portion 106, a first strip section 108 (or first grill section, first grated section, or first barred section) disposed at a first side 110 of the peripheral frame portion 106, and a second strip section 112 (or second grill section, second grated section, or second barred section) disposed at a second side 114 of the peripheral frame portion 106. In particular, the first strip section 108 and the second strip section 112 each comprises a plurality of spaced-apart strip portions (or elongated portions or column portions) extending from a first part 116 of the peripheral frame portion 106 to a second part 118 of the peripheral frame portion 106.

With such a configuration, the antenna structure 100 has been found to result in better performance in magnetic field generation when compared with a conventional antenna structure having the same or similar overall size/dimension, and in particular, an increase in the strength of the magnetic field generated, as well as enhanced near-field distribution. This advantageously results in a more efficient antenna structure with improved reading distance (thus enlarges the interrogation zone) without requiring an increase in the overall size of the antenna structure or an increase in the transmitting power. Experimental results illustrating the above advantages will be described later below according to various example embodiments of the present invention.

In various embodiments, as illustrated in FIG. 1, the first part 116 of the peripheral frame portion 106 is a lower part (or bottom part) of the peripheral frame portion 106 and the second part 118 of the peripheral frame portion 106 is an upper part (or top part) of the peripheral frame portion 106. Various embodiments of the present invention may describe a device/apparatus or structure with respect to a particular orientation such as the antenna structure 100 as illustrated in FIG. 1. However, it will be appreciated that the device/apparatus or structure may be operable in various orientations, and it thus should be understood that any of the terms such as "upper", "lower", "top", "bottom", "base", "down", "left", "right", "sideways", "downwards", "x-axis", "y-axis", "z-axis", and so on, when used herein are used for convenience and to aid understanding of relative positions or directions, and not intended to limit the orientation of the device/apparatus or structure.

It will be understood by a person skilled in the art that the shape of the antenna 104 (in particular, the peripheral frame portion 106) is not limited to the rectangular shape shown in FIG. 1, which is provided by way of an example for illustration purposes only and not limitation. It will be appreciated that the shape of the antenna may be configured to be of any shape as appropriate based on various circumstances as long as the antenna forms a closed shape or loop. Various other possible shapes will be illustrated later according to various example embodiments of the present invention.

In various embodiments, the substrate 102 may be a printed circuit board (PCB). For example, the antenna 104 may be formed on either side of the PCB, or on both sides of the PCB. Furthermore, in various embodiments, the antenna 104 may be integrally formed on the substrate 102 (i.e., as a single integral member/element). That is, the peripheral frame portion 106 and the plurality of space-apart strip portions 430, 432 may be integrally formed (i.e., not separate elements) on the substrate 102.

Figure 2:
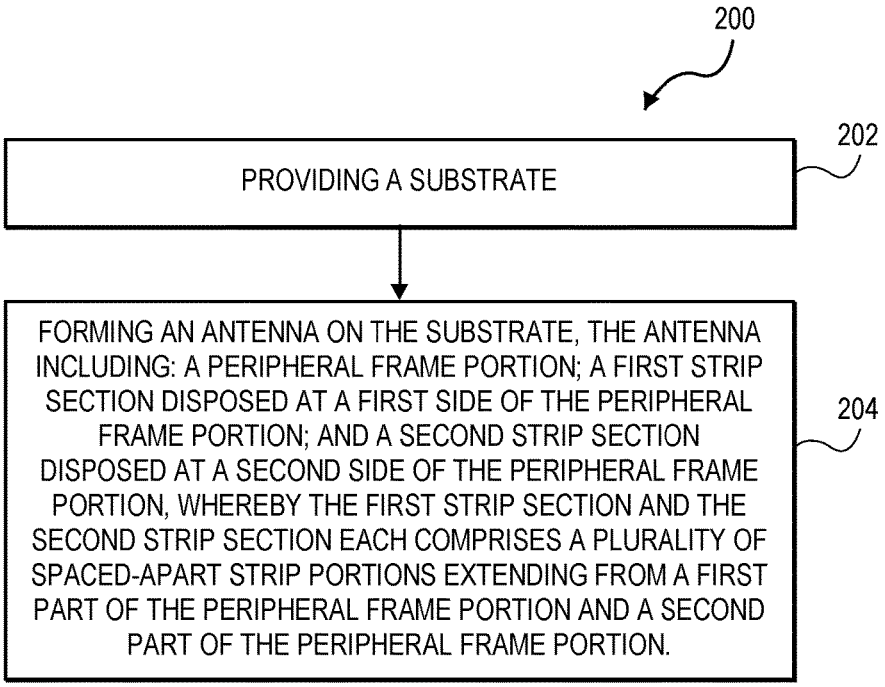
FIG. 2 depicts a schematic flow diagram illustrating a method of manufacturing an antenna structure as described with reference to FIG. 1 for an RFID reader.

FIG. 2 depicts a schematic flow diagram illustrating a method 200 of manufacturing an antenna structure 100 as described with reference to FIG. 1 for an RFID reader. The method 200 comprises a step 202 of providing a substrate 102, and forming an antenna 104 on the substrate 102, the antenna 104 having a peripheral frame portion 106, a first strip section 108 disposed at a first side 110 of the peripheral frame portion 106, and a second strip section 112 disposed at a second side 114 of the peripheral frame portion 106, whereby the first strip section 108 and the second strip section 112 each comprises a plurality of spaced-apart strip portions extending from a first part 116 of the peripheral frame portion 106 to a second part 118 of the peripheral frame portion 106.

According to various embodiments, the antenna 106 (i.e., the peripheral frame portion and the plurality of spaced-apart strip portions in the first strip section and the second strip section) may be made of conductive metallic strips and/or conductive wires. For example and without limitation, the metallic strip on the PCB may be formed by using a PCB etching process. The conductive wires configuration can be realized by positioning the wire on supporting materials such as, but not limited to, plastic, wood, or Styrofoam with required foam factor.

Figure 3:
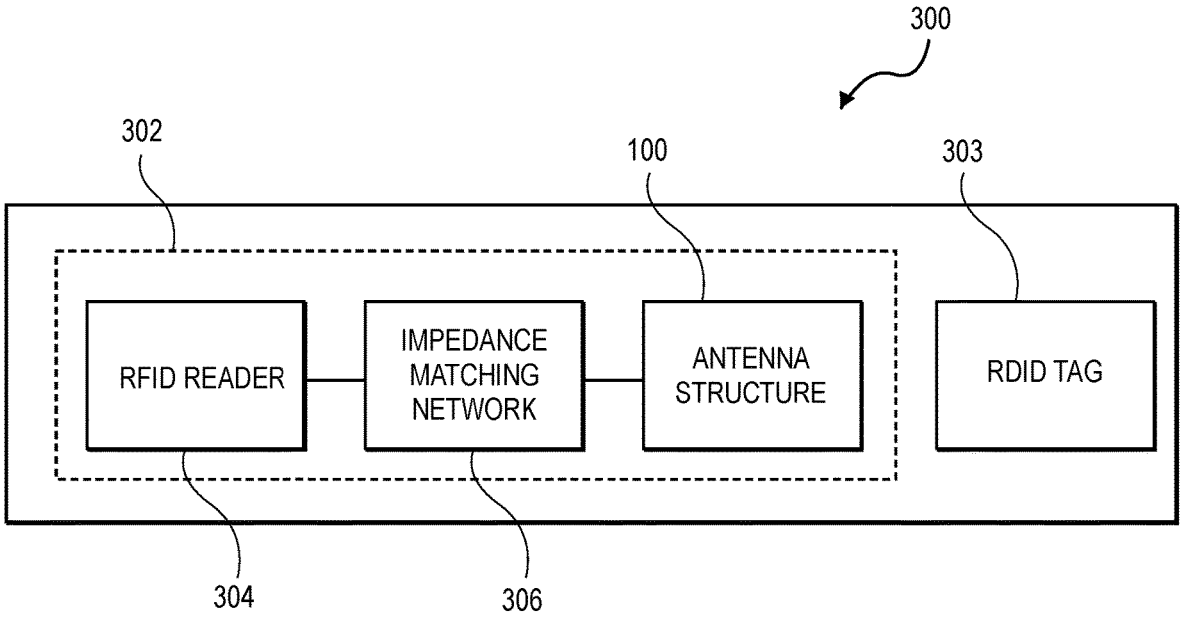
FIG. 3 depicts a schematic drawing of an RFID system according to various embodiments of the present invention including an RFID reader system and one or more RFID tags.

FIG. 3 depicts a schematic drawing of an RFID system 300 according to various embodiments of the present invention comprising an RFID reader system 302 and one or more RFID tags 303. The RFID reader system 302 may comprise an RFID reader 304 connected/coupled to an antenna structure 100 as described with reference to FIG. 1 to communicate with an RFID tag 303 through an inductive coupling. In various embodiments, the RFID reader 304 further comprises a radio frequency (RF) transceiver (or RF source) for generating an RF signal and process the detected signal from the RFID tag 303. The RF power (RF signal) from the RFID reader 304 is coupled to the antenna structure 100 and the antenna structure 100 is configured to generate a magnetic field based on the RF signal for communicating with the RFID tag 303, and an impedance matching circuit 306 is coupled to the antenna structure 100 for enhancing impedance matching between the antenna structure 100 and the RFID reader 304.

For example, the RFID tag 303 may have stored therein information associated with an article, and the RFID reader system 302 is configured to communicate with the RFID tag 303 through an inductive coupling to obtain the information associated with the article. It will be appreciated that although FIG. 3 shows one RFID reader 304 and one RFID tag 304, the RFID system 300 is not limited as such, and a plurality of RFID readers 304 and/or a plurality of RFID tag 303 may be included in the RFID system 300 as appropriate based on various circumstances. For example and without limitation, an RFID system implemented in a library or bookstore may have an RFID tag associated with each book or article for identification and tracking purposes.

It will be appreciated to a person skilled in the art that the terminology used herein is for the purpose of describing various embodiments only and is not intended to be limiting of the present invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In order that the present invention may be readily understood and put into practical effect, various example embodiments of the present inventions will be described hereinafter by way of examples only and not limitations. It will be appreciated by a person skilled in the art that the present invention may, however, be embodied in various different forms and should not be construed as limited to the example embodiments set forth hereinafter. Rather, these example embodiments are provided so that this disclosure will be thorough and complete, and will fully convey the scope of the present invention to those skilled in the art.

Figure 4:
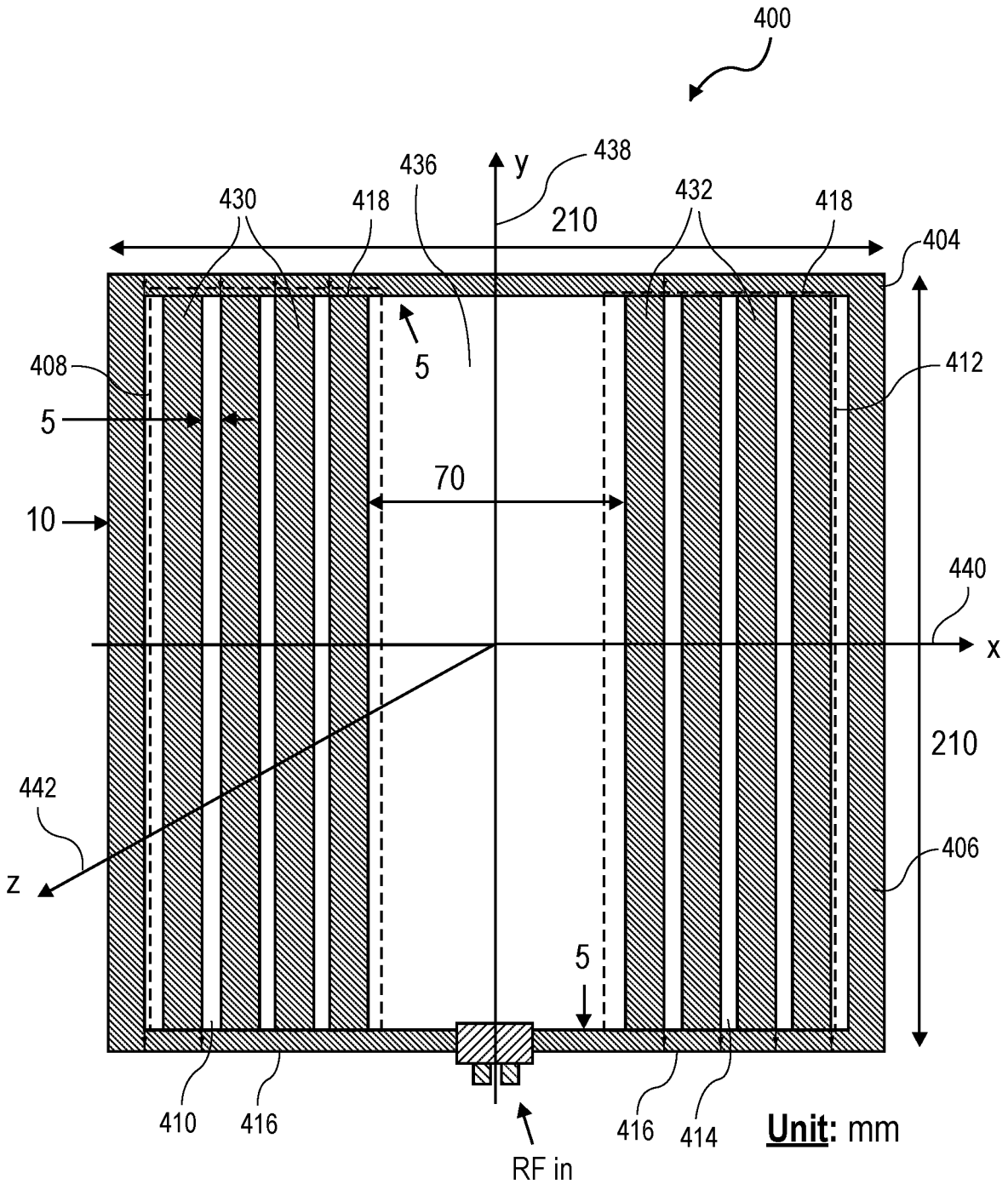
FIG. 4 depicts a schematic drawing of an antenna structure for an RFID reader according to an example embodiment of the present invention.

FIG. 4 depicts a schematic drawing of an antenna structure 400 for an RFID reader according to an example embodiment of the present invention. The antenna structure 400 comprises a substrate (not shown in FIG. 4), and an antenna 404 disposed on the substrate. The antenna 404 comprises a peripheral frame portion 406, a first strip section 408 disposed at a first side 410 of the peripheral frame portion 406, and a second strip section 412 disposed at a second side 414 of the peripheral frame portion 406. In particular, the first strip section 408 and the second strip section 412 each comprises a plurality of spaced-apart strip portions 430, 432 extending from a first part 416 of the peripheral frame portion 406 to a second part 418 of the peripheral frame portion 106.

In the example embodiment of FIG. 4, with respect to the orientation of the antenna structure 400 as shown in FIG. 4, the first part 416 of the peripheral frame portion 406 is a lower part (or top part) of the peripheral frame portion 406 and the second part 418 of the peripheral frame portion 406 is an upper part (or bottom part) of the peripheral frame portion 406. As explained hereinbefore, although the antenna structure 400 has been described with respect to the orientation as shown in FIG. 4, it will be appreciated that the antenna structure 400 may be operable in various orientations.

In the example embodiment of FIG. 4, as shown, each of the first strip section 408 and second strip section 412 has four spaced-apart strip portions 430, 432. It will be appreciated by a person skilled in the art that the number of spaced-apart strip portions in each strip section is not limited to four as shown in FIG. 4, which is by way of an example for illustration purposes only and not limitation. It will be appreciated that the number of spaced-apart strip portions in each strip section can be more or less as appropriate and will be illustrated in various example embodiments later.

In various example embodiments, the antenna structure 400 further comprises an impedance matching circuit coupled thereto (in particular, the antenna 404) for enhancing impedance matching between the antenna structure 406 and a radio frequency (RF) source/transceiver in the RFID reader. In this regard, the RF source generates an RF signal, and the RF source is coupled to the antenna structure 400 whereby the antenna structure 400 generates a magnetic field based on the RF signal for communicating with an RFID tag.

In various example embodiments, the first side 410 is opposite to the second side 414, and the first strip section 408 disposed at the first side 410 and the second strip section 412 disposed at the second side 414 define an opening 436 therebetween in the antenna 404. In the example embodiment of FIG. 4, with respect to the orientation of the antenna structure 400 as shown in FIG. 4, the first side 410 is the left side of the peripheral frame portion 406, and the second side 414 is the right side of the peripheral frame portion opposite to the left side. For example, the opening 436 is provided to ensure the antenna structure 400 operates as a loop-type antenna to generate a strong magnetic field in the near-field zone. Furthermore, in various embodiments, the size of the opening 436 is configured to control the magnetic field distribution of the antenna structure 400 along x-axis.

In various example embodiments, the spaced-apart strip portions 430, 432 in the first strip section 408 and/or the second strip section 412 are substantially parallel to each other. For example, the spacing between the parallel strip portions can be configured to control the input impedance and the magnetic field distribution of the antenna structure 400.

In various example embodiments, the first strip section 408 and the second strip section 412 are substantially symmetrical with respect to a central axis (e.g., y-axis in FIG. 4) 438 of the antenna 404 passing through the first and second parts 416, 418 of the peripheral frame portion 406. For example, such a symmetry offers a symmetrical magnetic field distribution with respect to a central axis (e.g., y-axis in FIG. 4) 438 of the antenna 404. In various embodiments, the first strip section 408 and the second strip section 412 can be asymmetrically positioned with respect to the central axis to generate an asymmetrical magnetic field distribution with respect to the central axis 438.

By way of example only and without limitations, exemplary dimensions of the antenna structure 400 according to an example embodiment suitable for high frequency (HF) RFID applications at 13.56 MHz are shown in FIG. 4. The frequency of 13.56 MHz is selected as it is a standardized reader frequency for HF RFID applications and thus has a practical application. As shown in FIG. 4, the antenna structure 400 according to the example embodiment is designed to have a dimension of about 210 mm (width) by 210 mm (length). The width of the peripheral frame portion 406 is about 10 mm, the width of each of the spaced-apart strip portions 430, 432 is about 5 mm, the width of the space/gap between each pair of adjacent spaced-apart strip portions 430, 432 is about 5 mm, and the width of the opening 436 between the first strip section 408 and the second strip section 412 is about 70 mm.

Figure 5A:
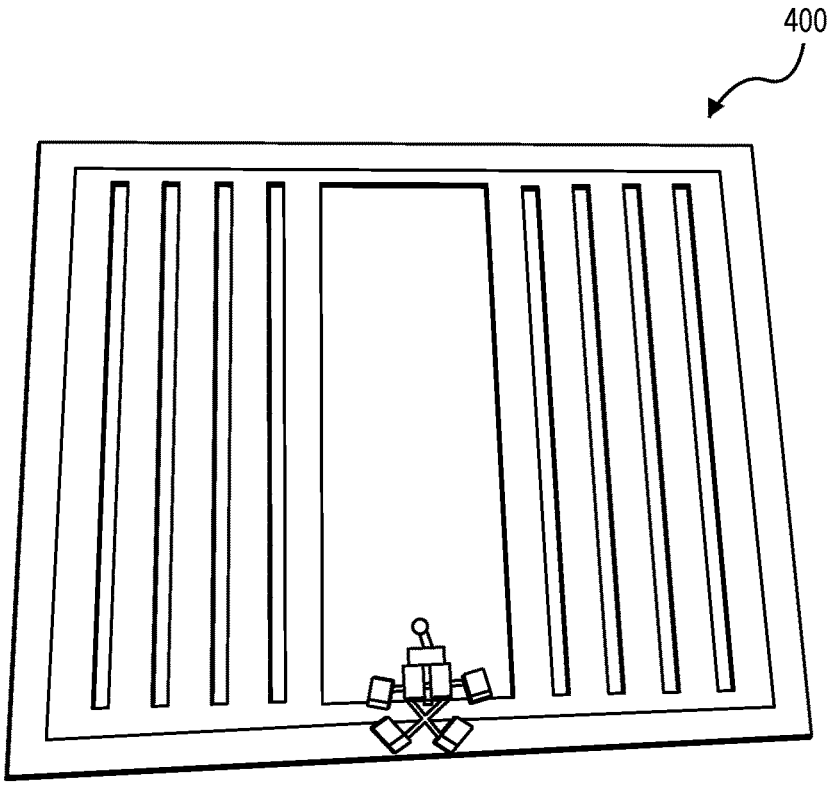
FIG. 5A depicts an image of an antenna structure according to an example embodiment of the present invention tested in an experiment for obtaining experimental results.
Figure 5B:
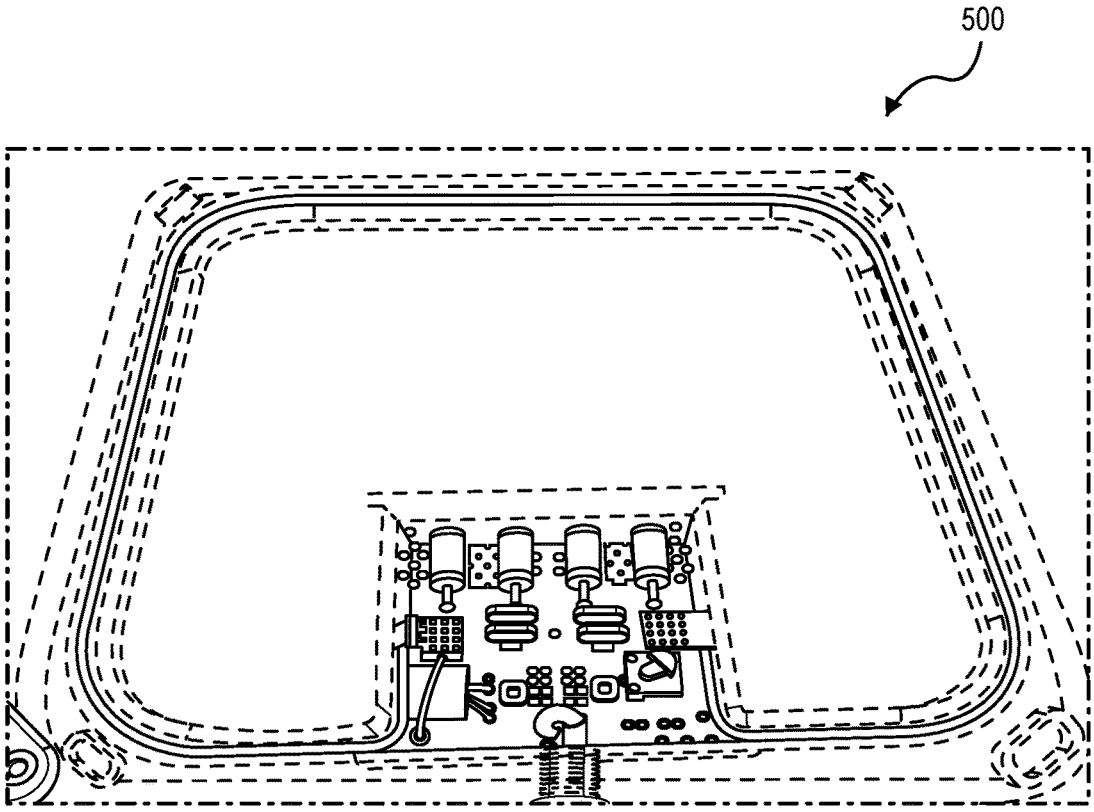
FIG. 5B depicts an image of the conventional antenna structure tested in an experiment for obtaining experimental results.

As mentioned hereinbefore, the antenna structure described according to various embodiments has been found to result in better performance in magnetic field generation when compared with a conventional antenna structure having the same or similar overall size/dimension, and in particular, an increase in the strength of the magnetic field generated, as well as enhanced near-field distribution. In order to illustrate the above enhanced properties of the antenna structure according to various embodiments, experimental results comparing the above-described antenna structure 400 having dimensions configured to be suitable to operate at 13.56 MHz and a conventional antenna structure 400 having a single loop antenna and having substantially the same dimension as the antenna structure 400 will now be discussed. In this regard, FIG. 5A depicts an image of the antenna structure 400 and FIG. 5B depicts an image of the conventional antenna structure 500 tested to obtain the experimental results.

Figure 6:
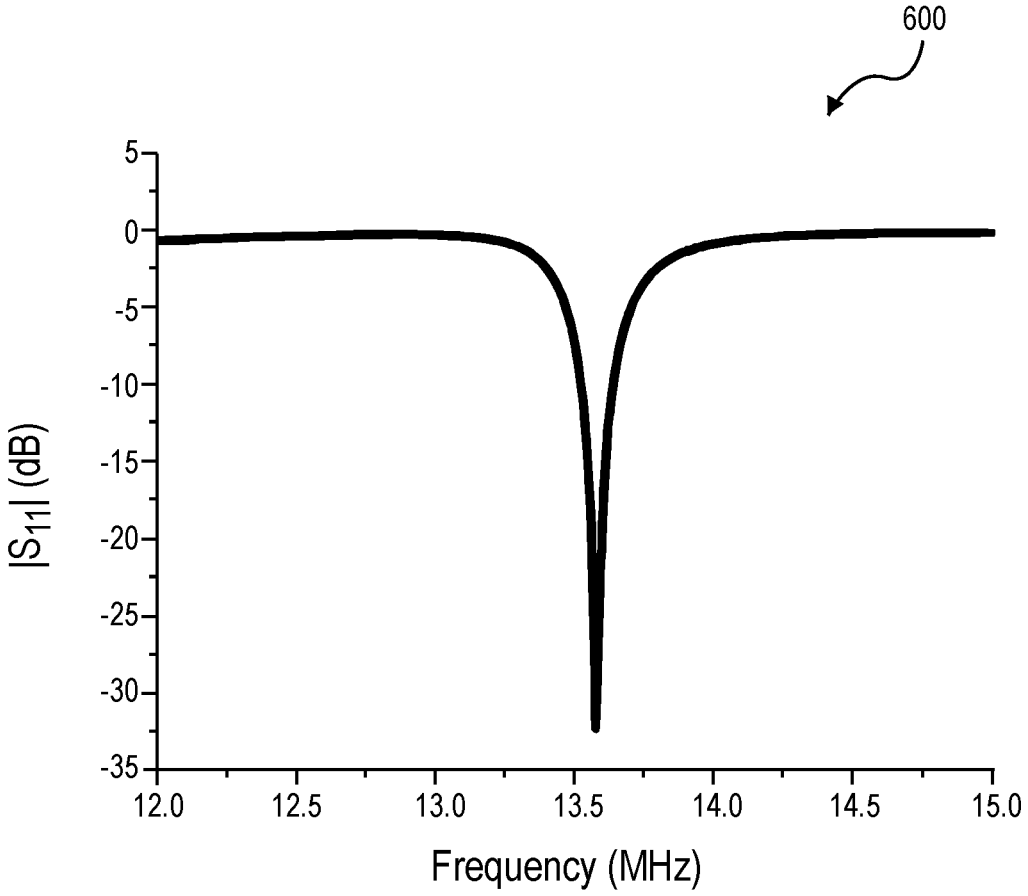
FIG. 6 depicts a plot of the measured Reflection Coefficient ($|S_{11}|$) of the antenna structure shown in FIG. 5A.

First, the antenna structure 400 is tested for suitability to operate at a frequency of 13.56 MHz. FIG. 6 depicts a plot of the measured Reflection Coefficient ($|S_{11}|$) of the antenna structure 400 tested. As can be observed from FIG. 6, the antenna structure 400 achieved good impedance matching at 13.56 MHz, thus demonstrating that the antenna structure 400 is suitable for operation at a frequency of 13.56 MHz.

Figure 7A:
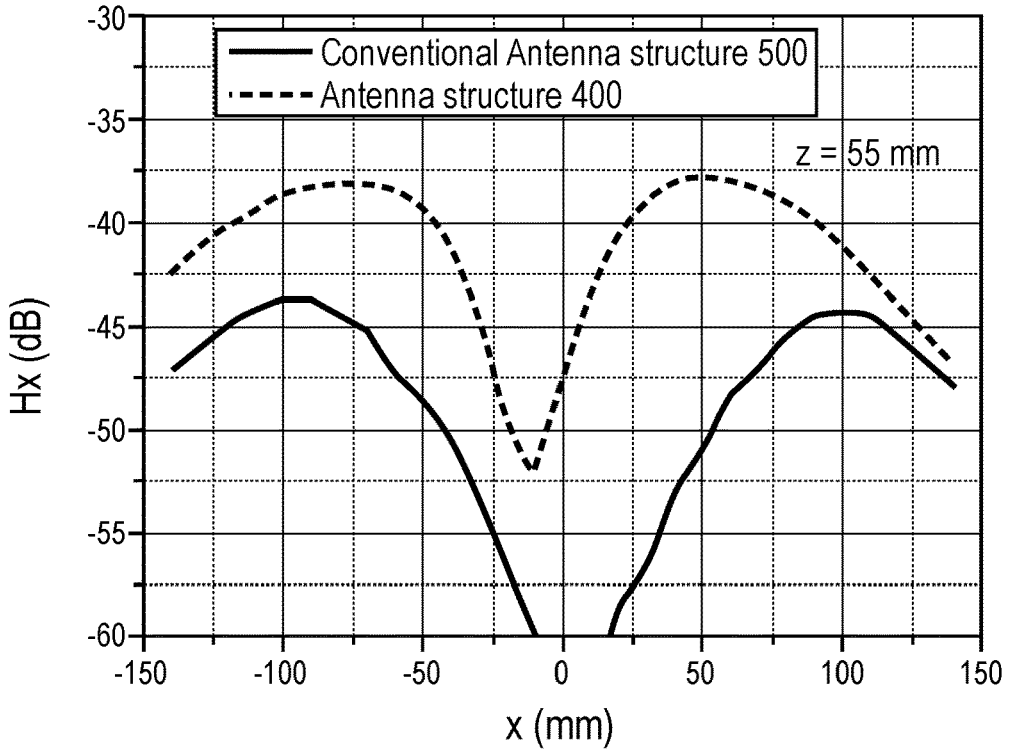
FIGS. 7A and 7B depict plots of the measured magnetic field strength along the x-axis of both the antenna structure as shown in FIG. 5A and the conventional antenna structure as shown in FIG. 5B at two chosen distances therefrom in the z-axis direction.
Figure 7B:
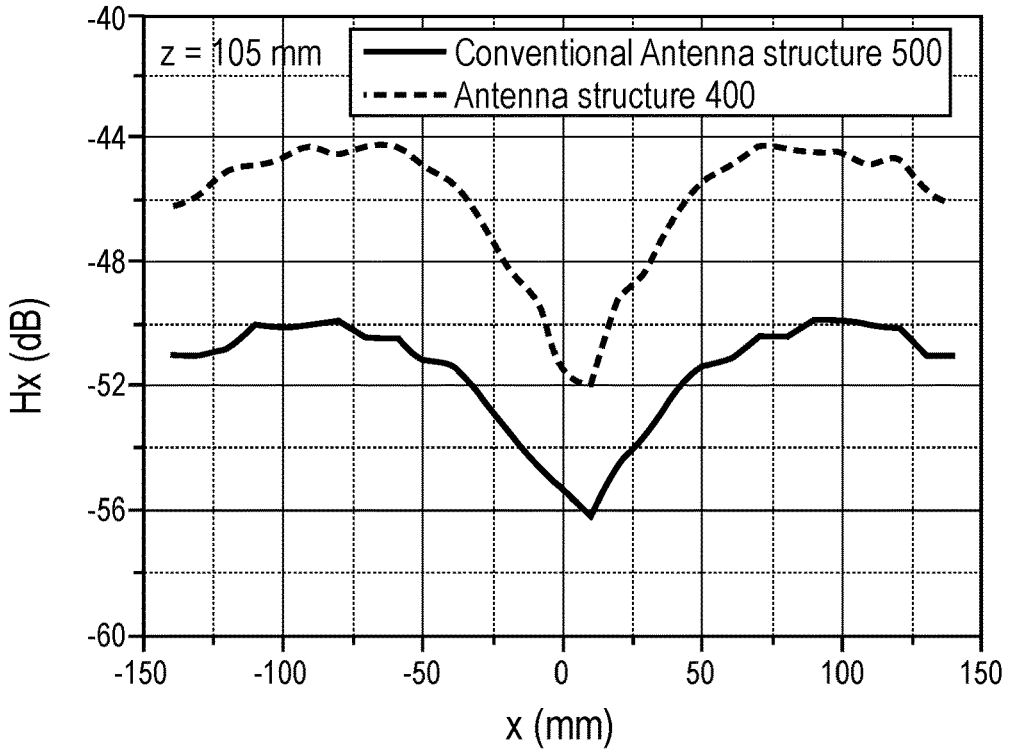

FIGS. 7A and 7B depict plots of the measured magnetic field strength along the x-axis 440 (e.g., see FIG. 4) (i.e., $H_x$ (dB)) of both antenna structures (i.e., the antenna structure 400 and the conventional antenna structure 500) at two chosen distances therefrom in the z-axis 442 direction (e.g., see FIG. 4), namely, at z=55 mm and at z=105 mm from the antenna structure. From FIGS. 7A and 7B, it can be observed that the antenna structure 400 generated noticeably stronger magnetic field than the conventional antenna structure 500 for both distances over the entire range measured (along the x-axis). For example, differences in magnetic field of up to about 6 dB at z=55 mm and at z=105 were measured which demonstrate a significant enhancement over the conventional antenna structure 500.

Figure 7C:
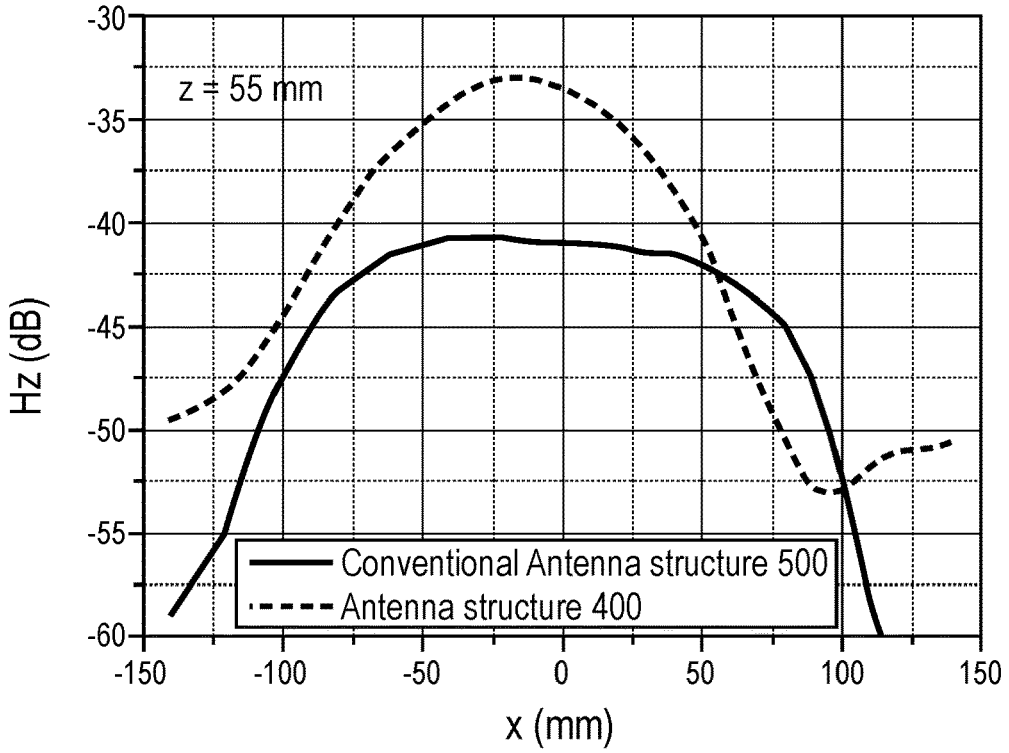
FIGS. 7C and 7D depict plots of the measured magnetic field strength along the z-axis (i.e., $H_z$ (dB)) of both antenna structures as shown in FIG. 5A and the conventional antenna structure as shown in FIG. 5B at the same two chosen distances therefrom in the z-axis direction.
Figure 7D:
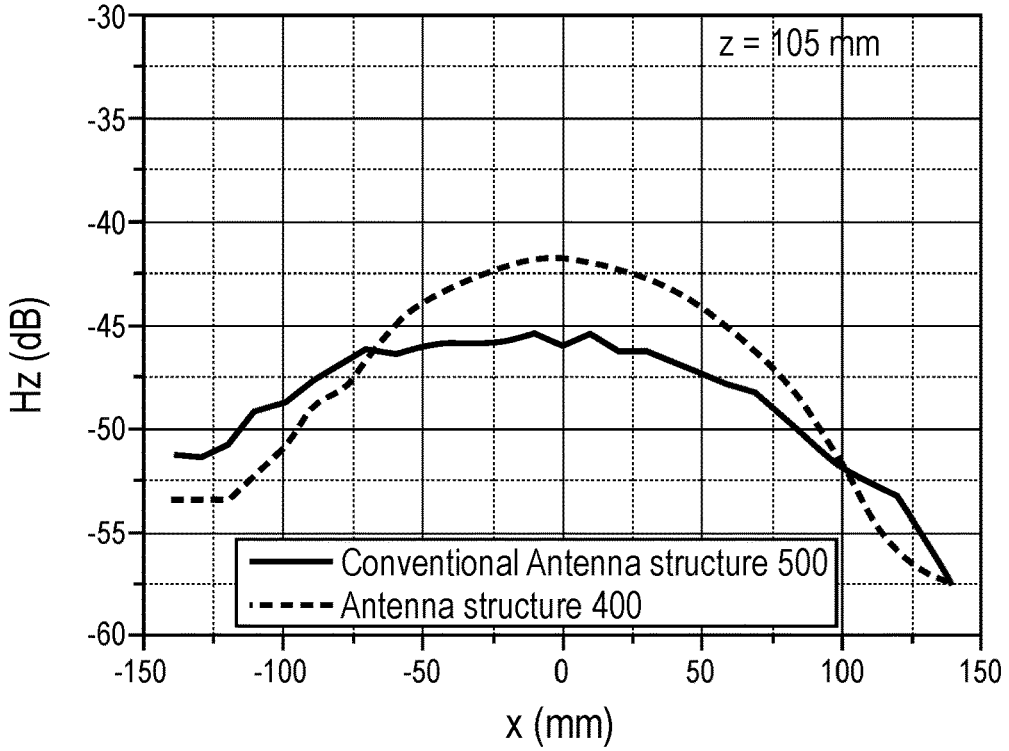

FIGS. 7C and 7D depict plots of the measured magnetic field strength along the z-axis (i.e., $H_z$ (dB)) of both antenna structures (i.e., the antenna structure 400 and the conventional antenna structure 500) at the same two chosen distances therefrom in the z-axis 442 direction, i.e., at z=55 mm and at z=105 mm from the antenna structure. From FIGS. 7C and 7D, it can be observed that the antenna structure 400 generated noticeably stronger magnetic field than the conventional antenna structure 500 for both distances over a wide range measured (in the x-axis). For example, differences in magnetic field up to about 8 dB at z=55 mm and up to about 3 dB at z=105 mm were measured which demonstrate a significant enhancement over the conventional antenna structure 500, especially for the case at z=55 mm.

Accordingly, the above experimental results demonstrate that the design/configuration of the present antenna structure as described hereinbefore according to various embodiments of the present invention resulted in enhanced performance in magnetic field generation, and in particular, a significant increase in the strength of the magnetic field generated over a wide range of distances in both the x-direction 440 and the z-direction 442. The present antenna structure can thus advantageously improve reading/detection distance, which enlarges the antenna structure's interrogation zone without requiring an increase in the overall size of the antenna structure or an increase in the transmitting power. For example, the increase in the interrogation zone in the x-direction 440 is particularly important as it advantageously enables the antenna structure to communicate with a wider range of RFID tags associated with objects/articles arranged along the x-axis (e.g., items on shelves), while the increase in the interrogation zone in the z-direction 442 advantageously enables the antenna structure to communicate with objects/articles located further from the antenna structure.

Figure 8A:
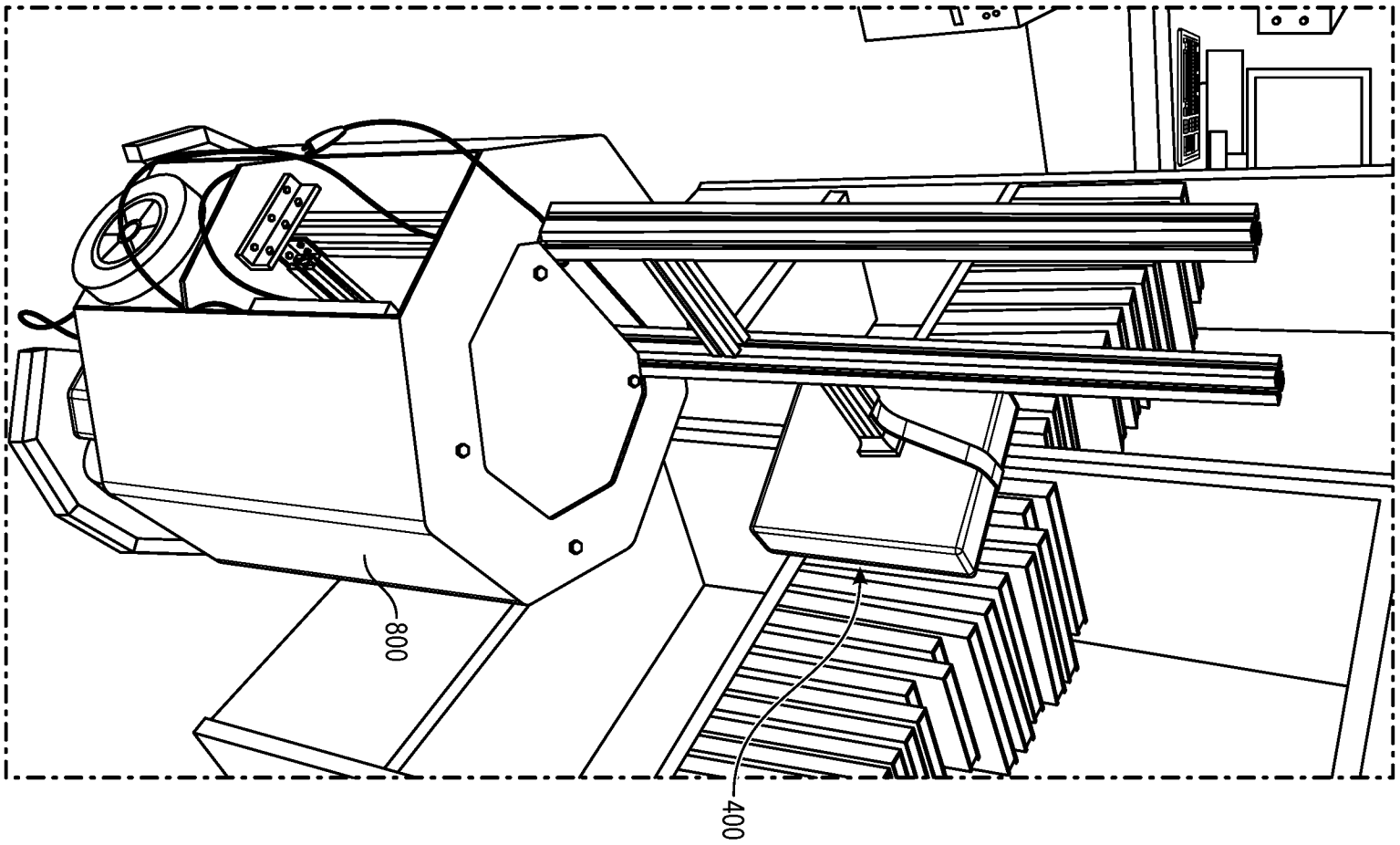
FIG. 8A depicts an image of an RFID reader system with an antenna structure according an example embodiment of the present invention.
Figure 8B:
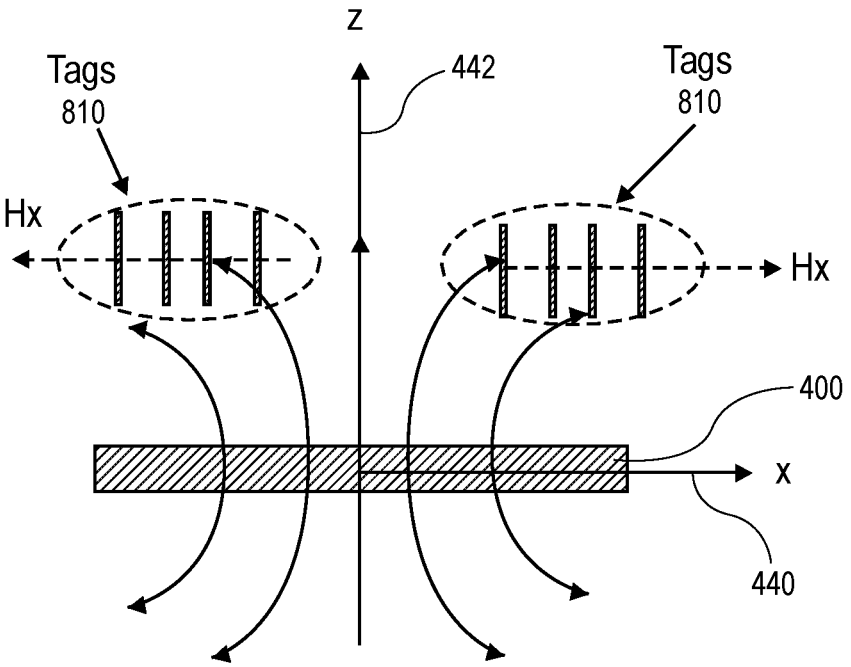
FIG. 8B depicts a schematic drawing illustrating the magnetic field generated by the antenna structure in the example of FIG. 8A for inductive coupling between the antenna structure and the RFID tags.

By way of example only and without limitations, an example application of an RFID reader system 800 with the antenna structure 400 as described herein according to various embodiments is shown in FIG. 8A. FIG. 8B depicts a schematic drawing showing the magnetic field generated by the antenna structure 400 in the example of FIG. 8A for inductive coupling between the antenna structure 400 and the RFID tags 810. This example application is a robot-assisted RFID shelf reading system. In this example, the RFID reader system 800 is arranged to detect the RFID tags attached to the books on the shelf as illustrated in FIG. 8A. For example, since the books (or RFID tags) are positioned perpendicular to the x-y plane of antenna structure, it is advantageous that the antenna structure is able to generate strong magnetic field ($H_x$) along the x-axis as described hereinbefore so that there is maximum magnetic flux going through the RFID tags associated with the books for largest detection/reading range along the x-axis (see FIG. 8B), thereby enabling the RFID reader system 800 to communicate with a wider range of books (i.e., RFID tags associated therewith) arranged along the x-axis. This example illustrates the significance of the enhanced magnetic field generated by the antenna structure according to various embodiments along the x-axis. This example also demonstrates the configuration/design of the antenna structure for controlling near-field distribution in a particular zone, and in this example, enhancing near-field distribution along the x-axis.

As mentioned hereinbefore, it will be appreciated by a person skilled in the art that the number of spaced-apart strip portions in each strip section is not limited to four as shown in FIG. 4, and that it will be appreciated that the number of spaced-apart strip portions in each strip section can be more or less as appropriate. As an example only, FIG. 9A depicts a schematic drawing of an antenna structure 900 having five space-apart strip portions in each strip section according to an example embodiment of the present invention.

Figure 9A:
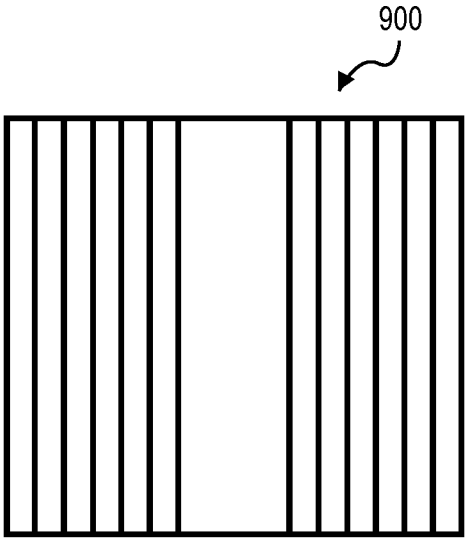
FIGS. 9A to 9D depict schematic drawings of various strip section configurations of the antenna structure according to various example embodiments of the present invention.

In various embodiments, each adjacent pair of the spaced-apart strip portions in the first strip section is spaced apart by a first distance and each adjacent pair of the spaced-apart strip portions in the second strip section is spaced apart by a second distance, whereby the first distance and the second distance are substantially the same, such as the antenna structure as illustrated in FIGS. 4 and 9A. For example, spacing the strip portions by the same distance eases the antenna configuration and generates symmetrical magnetic field distribution.

Figure 9B:
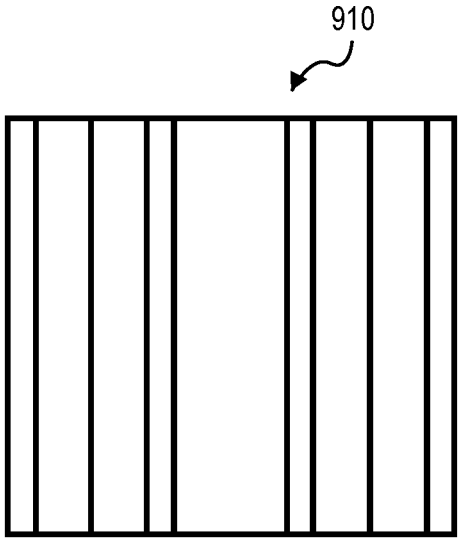

In various embodiments, at least one of the adjacent pairs of the spaced-apart strip portions in the first strip section is spaced apart by a distance which is different to that of another adjacent pair of the space-apart strip portions in the first strip section. In addition to or alternatively, at least one of the adjacent pairs of the spaced-apart strip portions in the second strip section is spaced apart by a distance which is different to that of another adjacent pair of the space-apart strip portions in the second strip section. As an example only, FIG. 9B depicts a schematic drawing of an antenna structure 910 configured in the above-described manner. For example, such an arrangement of the non-uniform spacing between the strip portions enables the tuning of the input impedance of the antenna structure for controlling the magnetic distribution of the antenna structure.

Figure 9C:
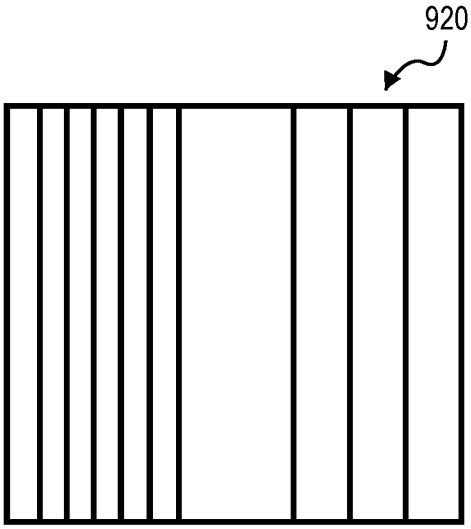
Figure 9D:
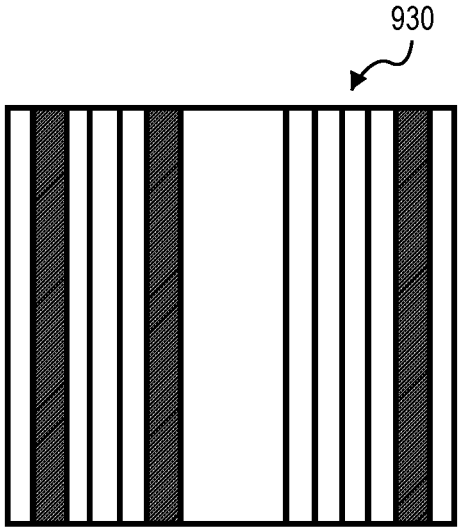
Figure 10A:
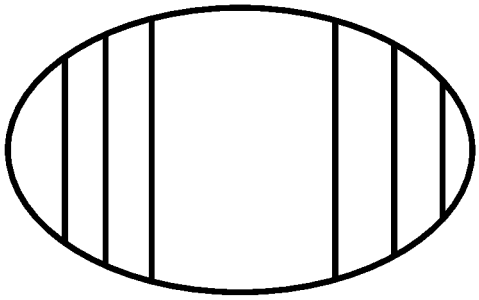
FIGS. 10A to 10F depict schematic drawings of various shape configurations of the antenna structure according to various example embodiments of the present invention.
Figure 10B:
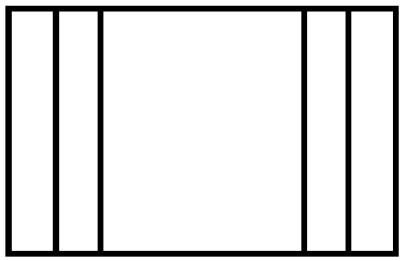
Figure 10C:
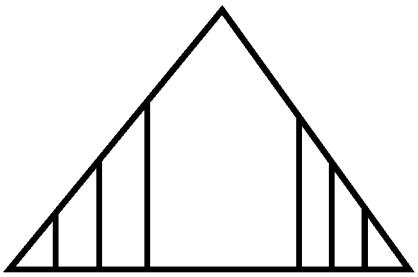
Figure 10D:
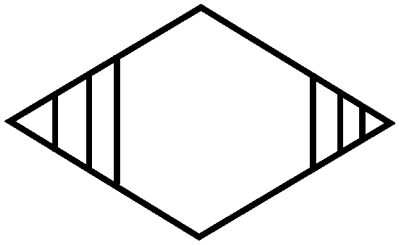
Figure 10E:
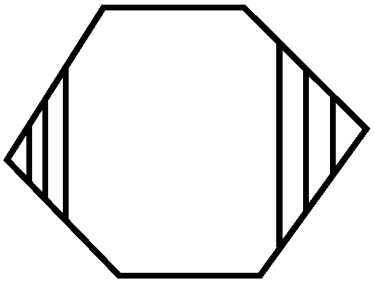
Figure 10F:
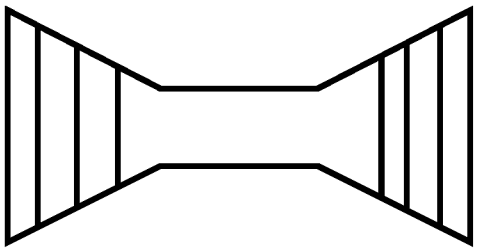

In various embodiments, each adjacent pair of the spaced-apart strip portions in the first strip section is spaced apart by a first distance and each adjacent pair of the spaced-apart strip portions in the second strip section is spaced apart by a second distance, whereby the first distance and the second distance are different. As an example only, FIG. 9C depicts a schematic drawing of an antenna structure 900 whereby the space-apart strip portions in the first strip section are spaced apart at a distance which is different from that of the space-apart strip portions in the second strip section. For example, such a configuration can be utilized to tune the input impedance of the antenna structure and generate an asymmetrical magnetic field distribution for specific applications.

In various embodiments, widths of the spaced-apart strip portions in the first strip section and/or widths of the spaced-apart strip portions in the second strip section are substantially the same, such as the antenna structure as illustrated in FIGS. 4 and 9A. For example, spaced-apart strip portions having substantially the same widths ease the antenna configuration and generate symmetrical magnetic field distribution.

In various embodiments, at least one of the spaced-apart strip portion in the first strip section has a width which is different to a width of another spaced-apart strip portion in the first strip section. In addition to or alternatively, at least one of the spaced-apart strip portion in the second strip section has a width which is different to a width of another spaced-apart strip portion in the second strip section. For example, configuring strip portions with different widths enables the tuning of the input impedance of the antenna structure for controlling the magnetic field distribution of the antenna structure.

The antenna 404 as shown in FIG. 4 may be referred to as a loop antenna. As mentioned hereinbefore, it will be understood by a person skilled in the art that the shape of the antenna (in particular, the peripheral frame portion) is not limited to the rectangular (or square) shape as shown in FIGS. 1 and 4, which is by way of an example for illustration purposes only and not limitation. It will be appreciated that the shape of the antenna may be configured to be of any shape as appropriate based on various circumstances as long as the antenna forms a closed shape or loop. By way of examples only and without limitations, some other possible shapes are illustrated in FIGS. 10A to 10F according to various example embodiments of the present invention.

Accordingly, it will be appreciated by a person skilled in the art that the antenna is not limited to having any particular shape, size, or configuration (such as the number of strip portions and the spacing therebetween) as long as the antenna comprises a peripheral frame portion, a first strip section disposed at a first side of the peripheral frame portion; and a second strip section disposed at a second side of the peripheral frame portion, whereby the first strip section and the second strip section each comprises a plurality of spaced-apart strip portions extending from a first part of the peripheral frame portion to a second part of the peripheral frame portion, as described hereinbefore with reference to FIG. 1. Such an antenna has been found to result in enhanced performance in magnetic field generation when compared with a conventional antenna structure having the same or similar overall size/dimension as discussed hereinbefore. The specific shape, size or configuration can implemented/adjusted based on various circumstances for various applications.

Figure 11:
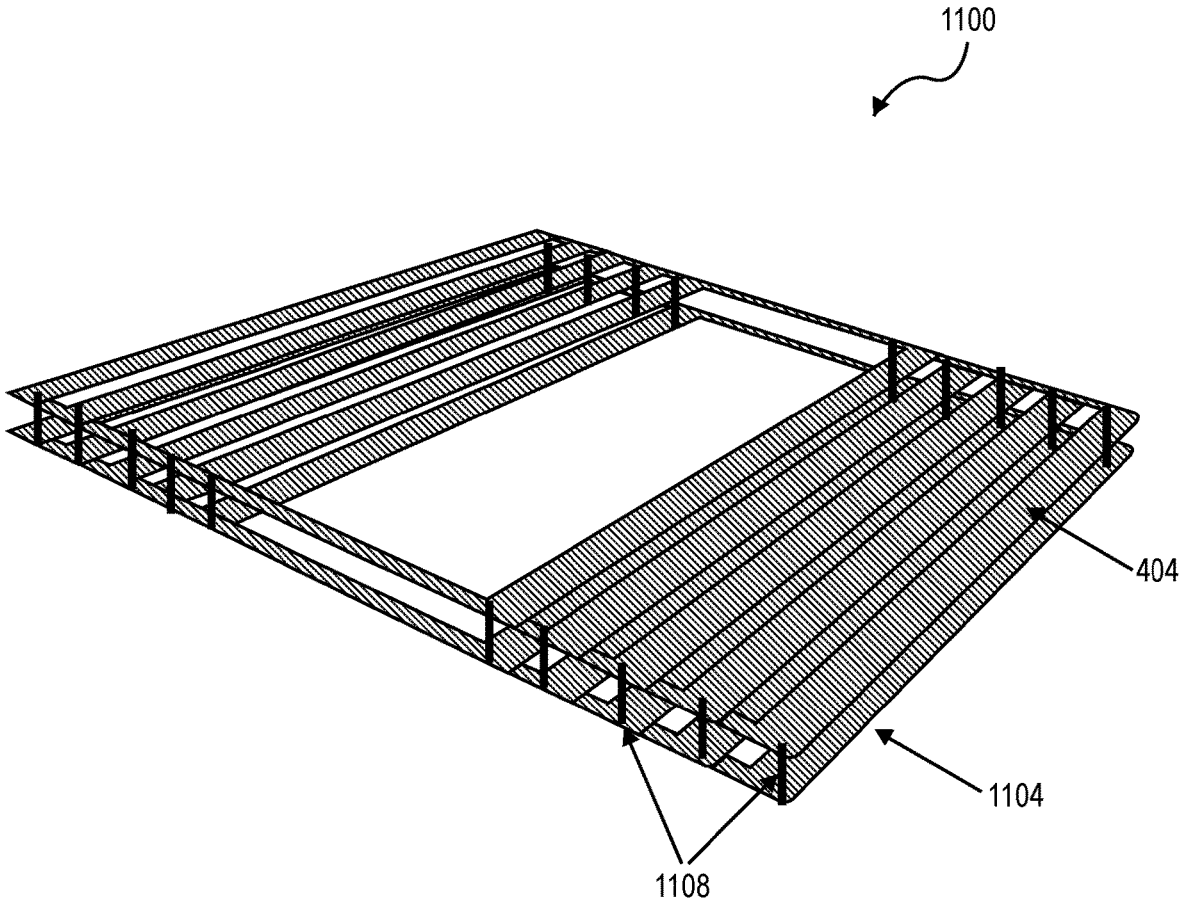
FIG. 11 depicts a schematic drawing of an antenna structure including multiple antennas according to various embodiments of the present invention.

FIG. 11 depicts a schematic diagram of an antenna structure 1100 according to various embodiments of the present invention. In particular, the antenna structure 1110 further comprises another antenna 1104 disposed on the substrate (not shown in FIG. 11), in addition to the antenna 404 as described hereinbefore. The antenna 1104 may have substantially the same structure as the antenna 404 described hereinbefore. For example, the antennas 404, 1104 may be disposed on opposite sides of the substrate such the antenna 404 forms an upper layer and the antenna 1104 forms a bottom layer of the antenna structure 1100. Furthermore, the antennas 404, 1104 are electrically coupled to each other through one or more shorting/connecting paths 1108 such as by connecting/conducting posts or vias as illustrated in FIG. 11.

In various embodiments, further antennas having substantially the same structure as the antenna 404 may be incorporated into the antenna structure. For example, each adjacent pair of antennas may be separated by a substrate located therebetween. All the antennas may also be electrically coupled through shorting/connecting paths.

Figure 12A:
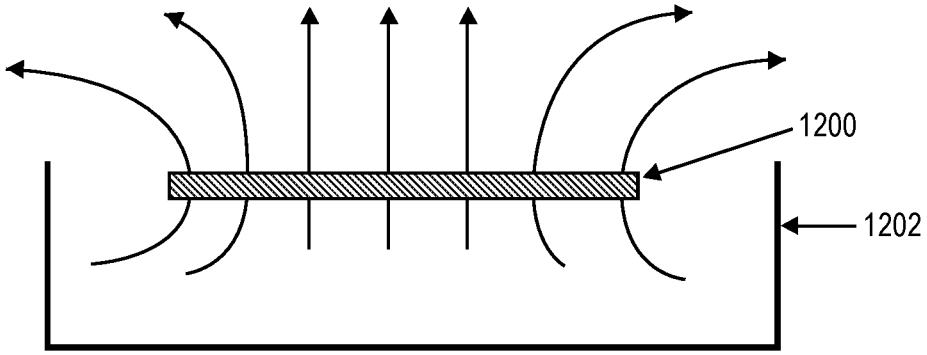
FIGS. 12A to 12C depict schematic drawings of various elements that may be arranged with the antenna structure according to various embodiments of the present invention for various purposes.
Figure 12B:
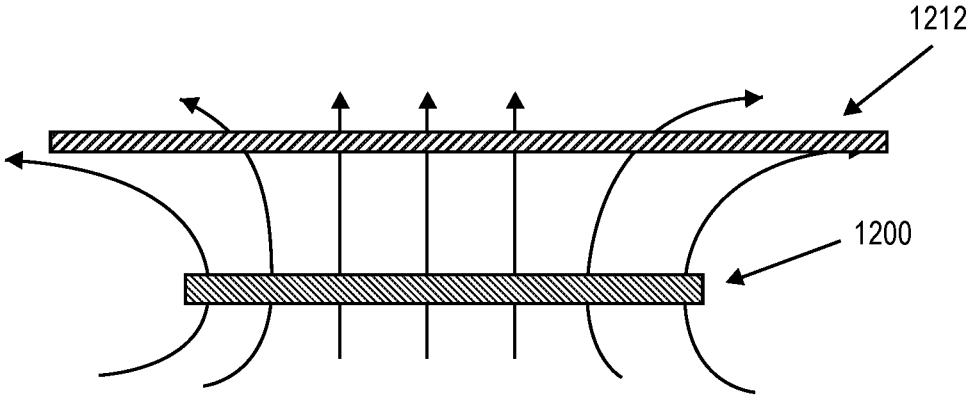
Figure 12C:
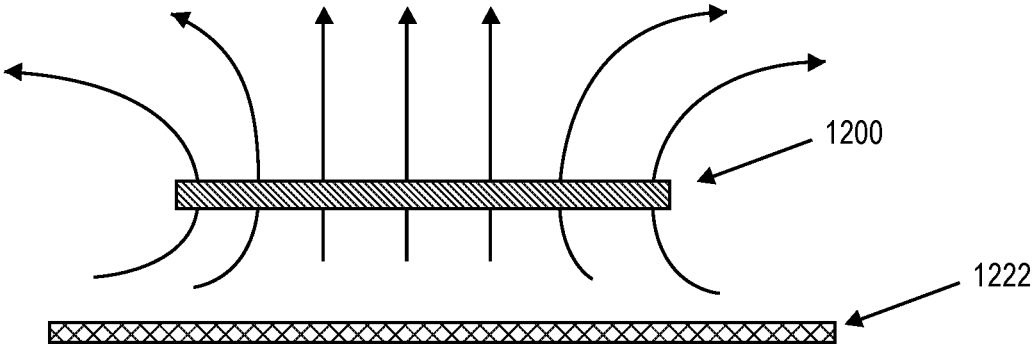

It will be appreciated that various elements may be arranged with the antenna structure described hereinbefore according to various embodiments of the present invention for various purposes. For example, FIG. 12A illustrates the antenna structure 1200 having a cavity structure 1202 arranged behind the antenna structure 1200, FIG. 12B illustrates the antenna structure 1200 having a lens 1212 arranged in front of the antenna structure 1210, and FIG. 12C illustrates an antenna structure 1220 having a reflector (e.g., artificial magnetic conductor (AMC) or perfect electric conductor (PEC)) arranged behind the antenna.

While embodiments of the present invention have been particularly shown and described with reference to specific embodiments, it should be understood by those skilled in the art that various changes in form and detail may be made therein without departing from the scope of the present invention as defined by the appended claims. The scope of the present invention is thus indicated by the appended claims and all changes which come within the meaning and range of equivalency of the claims are therefore intended to be embraced.

What is claimed is:

1. An antenna structure for a radio frequency identification (RFID) reader, the antenna structure comprising:

a substrate; and an antenna disposed on the substrate, the antenna comprising:

a peripheral frame portion;

a first strip section disposed at a first side of the peripheral frame portion; and a second strip section disposed at a second side of the peripheral frame portion, wherein the first strip section and the second strip section each comprises a plurality of spaced-apart strip portions, each strip portion extending from a first part of the peripheral frame portion to a second part of the peripheral frame portion, wherein at least one of the spaced-apart strip portions in the first strip section has a width which is different from a width of another spaced-apart strip portion in the first strip section, and/or at least one of the spaced-apart strip portions in the second strip section has a width which is different from a width of another spaced-apart strip portion in the second strip section, and wherein the antenna is configured as a loop antenna, the first strip section and the second strip section being disposed to define an opening therebetween in the antenna.

2. The antenna structure according to claim 1, wherein the first part is a lower part of the peripheral frame portion and the second part is an upper part of the peripheral frame portion.

3. The antenna structure according to claim 1, wherein the first side is opposite to the second side, and the first strip section disposed at the first side and the second strip section disposed at the second side define an opening therebetween in the antenna.

4. The antenna structure according to claim 1, wherein the spaced-apart strip portions in the first strip section and/or the second strip section are substantially parallel to each other.

5. The antenna structure according to claim 1, wherein the first strip section and the second strip section are substantially symmetrical with respect to a central axis of the antenna passing through the first and second parts of the peripheral frame portion.

6. The antenna structure according to claim 1, wherein the first strip section and the second strip section are asymmetrical with respect to a central axis of the antenna passing through the first and second parts of the peripheral frame portion.

7. The antenna structure according to claim 1, wherein each adjacent pair of the spaced-apart strip portions in the first strip section is spaced apart by a first distance and each adjacent pair of the spaced-apart strip portions in the second strip section is spaced apart by a second distance, and wherein the first distance and the second distance are substantially the same.

8. The antenna structure according to claim 1, wherein each adjacent pair of the spaced-apart strip portions in the first strip section is spaced apart by a first distance and each adjacent pair of the spaced-apart strip portions in the second strip section is spaced apart by a second distance, and wherein the first distance and the second distance are different.

9. The antenna structure according to claim 1, wherein at least one of the adjacent pairs of the spaced-apart strip portions in the first strip section is spaced apart by a distance which is different from that of another adjacent pair of the space-apart strip portions in the first strip section, and/or at least one of the adjacent pairs of the spaced-apart strip portions in the second strip section is spaced apart by a distance which is different from that of another adjacent pair of the space-apart strip portions in the second strip section.

10. The antenna structure according to claim 1, wherein widths of the spaced-apart strip portions in the first strip section and/or widths of the spaced-apart strip portions in the second strip section are substantially the same.

11. The antenna structure according to 1, wherein the peripheral frame portion forms a closed shape.

12. The antenna structure according to claim 1, wherein the peripheral frame portion forms a shape selected from the group consisting of circle, oval, and polygon.

13. The antenna structure according to claim 1, wherein the peripheral frame portion and the plurality of spaced-apart strip portions in the first strip section and the second strip section are made of conductive metallic strips and/or conductive wires.

14. The antenna structure according to claim 1, further comprising another antenna disposed on the substrate, said antenna and said another antenna being disposed on opposite sides of the substrate, said another antenna comprising:

a peripheral frame portion;

a first strip section disposed at a first side of the peripheral frame portion; and a second strip section disposed at a second side of the peripheral frame portion, wherein the first strip section and the second strip section each comprises a plurality of spaced-apart strip portions extending from a first part of the peripheral frame portion to a second part of the peripheral frame portion, wherein said antenna and said another antenna are electrically coupled to each other.

15. A method of manufacturing an antenna structure for a radio frequency identification (RFID) reader, the method comprising:

providing a substrate;

forming an antenna on the substrate, the antenna comprising:

a peripheral frame portion;

a first strip section disposed at a first side of the peripheral frame portion; and a second strip section disposed at a second side of the peripheral frame portion, wherein the first strip section and the second strip section each comprises a plurality of spaced-apart strip portions, each strip portion extending from a first part of the peripheral frame portion to a second part of the peripheral frame portion, wherein at least one of the spaced-apart strip portions in the first strip section has a width which is different from a width of another spaced-apart strip portion in the first strip section, and/or at least one of the spaced-apart strip portions in the second strip section has a width which is different from a width of another spaced-apart strip portion in the second strip section, and wherein the antenna is configured as a loop antenna, the first strip section and the second strip section being disposed to define an opening therebetween in the antenna.

16. The method of claim 15, wherein the peripheral frame portion and the plurality of spaced-apart strip portions in the first strip section and the second strip section are made of conductive metallic strips and/or conductive wires.

17. A radio frequency identification (RFID) reader system, comprising an antenna structure configured to communicate with an RFID tag through an inductive coupling, wherein the antenna structure comprises:

a substrate; and an antenna disposed on the substrate, the antenna comprising:

a peripheral frame portion;

a first strip section disposed at a first side of the peripheral frame portion; and a second strip section disposed at a second side of the peripheral frame portion, wherein the first strip section and the second strip section each comprises a plurality of spaced-apart strip portions, each strip portion extending from a first part of the peripheral frame portion to a second part of the peripheral frame portion, wherein at least one of the spaced-apart strip portions in the first strip section has a width which is different from a width of another spaced-apart strip portion in the first strip section, and/or at least one of the spaced-apart strip portions in the second strip section has a width which is different from a width of another spaced-apart strip portion in the second strip section, and wherein the antenna is configured as a loop antenna, the first strip section and the second strip section being disposed to define an opening therebetween in the antenna.

18. The RFID reader system according to claim 17, further comprising:

an RFID reader comprising a radio frequency source for generating a radio frequency signal, wherein the radio frequency signal is coupled to the antenna structure, and the antenna structure is configured to generate a magnetic field based on the radio frequency signal for communicating with the RFID tag, and an impedance matching circuit coupled to the antenna structure for enhancing impedance matching between the antenna structure and the RFID reader.

* * * * *